US006598503B1

(12) United States Patent
Cunningham

(10) Patent No.: US 6,598,503 B1
(45) Date of Patent: Jul. 29, 2003

(54) TOOL HANDLE

(75) Inventor: Earl T. Cunningham, Glenview, IL (US)

(73) Assignee: Eklind Tool Company, Franklin Park, IL (US)

( * ) Notice: Subject to any disclaimer, the term of this patent is extended or adjusted under 35 U.S.C. 154(b) by 0 days.

(21) Appl. No.: 10/055,647

(22) Filed: Jan. 23, 2002

(51) Int. Cl.[7] ..... B25B 23/16
(52) U.S. Cl. ..... 81/177.4; 81/490
(58) Field of Search ..... 81/177.4, 490, 81/177.1, 439, 177.2

(56) References Cited

U.S. PATENT DOCUMENTS 5,899,127 A * 5/1999 Shiao ..... 81/490
5,918,513 A * 7/1999 Ho ..... 81/490
6,237,451 B1 * 5/2001 Wei ..... 81/490
6,332,381 B1 * 12/2001 Vasudeva ..... 81/177.2

* cited by examiner

*Primary Examiner*—Lee D. Wilson
(74) *Attorney, Agent, or Firm*—Cook, Alex, McFarron, Manzo, Cummings & Mehler, Ltd.

(57) ABSTRACT

A tool handle for receiving L-key wrenches of various sizes including an elongated axle member and first and second generally-cylindrical members, each cylindrical member having a central bore for receiving the elongated axle member. The first and second cylindrical members are mounted in end-to-end relationship on the axle member, and each is rotatable independently both with respect to the other cylindrical member and to the axle. Each of the first and second cylindrical members has an elongated slot along its length and a plurality of through bores of varying size spaced radially from the central bore and adapted to receive the shank portion of an L-key. First and second end caps are secured to the elongated axle, and both the first and second end caps have a slot therein corresponding in shape to the elongated slot on its adjacent cylindrical member. The end caps are rotatable with respect to the first and second cylindrical members so that the slots in the end caps can be selectively aligned with the slot and radially-spaced through bores in its adjacent cylindrical member.

10 Claims, 2 Drawing Sheets

TOOL HANDLE

BACKGROUND OF THE INVENTION

The present invention relates to a tool handle and, more specifically, to an extension handle adapted for use with a number of different sizes of hex keys or similar tools.

Hex keys or wrenches are in wide use because of their positive engagement with the heads of their mating screws, which helps to ensure that the tool head does not slip off the screw head when torque is applied. Hex keys typically have a L-shape, with a short leg and a long leg, the end of each leg being adapted to mate with the complementarily-shaped recess in the head of a screw.

Because L-keys typically have a cross section that is the same size as the working end of the tool, they can be difficult to grasp. This problem is exacerbated if the working end of the long leg of the L-key is engaging the head of the screw, and torque is to be applied to the wrench by gripping the short leg.

As a result, extension handles or "cheater bars" have been developed that may be used in conjunction with a hex key to provide a larger, more comfortable gripping surface and, generally, a longer lever or moment arm for applying torque to the tool. See e.g., U.S. Pat. No. 1,172,656 to Yorgensen, U.S. Pat. No. 2,409,613 to Brooks, U.S. Pat. No. 2,715,028 to Dossie, U.S. Pat. No. 3,592,086 to Derwin, and U.S. Pat. No. 5,911,799 to Johnson et al.

While all the handles disclosed in these patents have been improvements over the improvised cheater bars that have been commonly used, such handles typically have not been usable with a wide array of tool sizes. Consequently, a user would need multiple extension handles for his set of wrenches. Alternatively, while the handle may accommodate a number of differently-sized L-keys, the configuration of the handle may be sufficiently complicated to make its manufacture difficult.

Accordingly, it is an object of the present invention to provide an extension handle that is useable with L-key wrenches, or similar tools, of multiple sizes.

It is a further option of the present invention to provide an extension handle that can be used with both the short leg or the long leg of the L-key.

It is a related object to provide an extension handle that permits the handle to be used with an L-key so as to create a T-handle.

It is a still further object to provide an extension handle that is simple to use, has few parts, and is easy to manufacture.

SUMMARY OF THE INVENTION

These objects, and others that will become apparent upon reference to the following detailed description and accompanying drawings, are provided by a tool handle for receiving L-key wrenches of various sizes including an elongated axle member and first and second generally-cylindrical members, each cylindrical member having a central bore for receiving the elongated axle member. The first and second cylindrical members are mounted in end-to-end relationship on the axle member, and each cylindrical member is rotatable independently both with respect to the other cylindrical member and to the axle. Each of the first and second cylindrical members has an elongated slot along its length and a plurality of through bores of varying size spaced radially from the central bore and adapted to receive the shank portion of an L-key. First and second end caps are secured to the elongated axle, and both the first and second end caps have a slot therein corresponding in shape to the elongated slot on its adjacent cylindrical member. The end caps are rotatable with respect to the first and second cylindrical members so that the slots in the end caps can be selectively aligned with the slot and radially-spaced through bores in its adjacent cylindrical member, thus permitting an L-key to be received in the radially-spaced through bores of the adjacent generally cylindrical member, or in the slot on the adjacent generally cylindrical member to, in turn, permit the L-key to be received in one of the through bores on the other generally cylindrical member.

DETAILED DESCRIPTION

A tool handle according the present invention is shown in FIGS. 1-8. While the tool handle is shown in conjunction with an L-key tool having a hex-shaped driving portion (and, more specifically, is a ball hex-key wrench), the tool handle may be used with L-keys adapted to drive nuts and screws with variously-shaped heads or sockets. For example, the L-key can be configured to mate with a star-shaped or Torx® socket.

Figure 1:
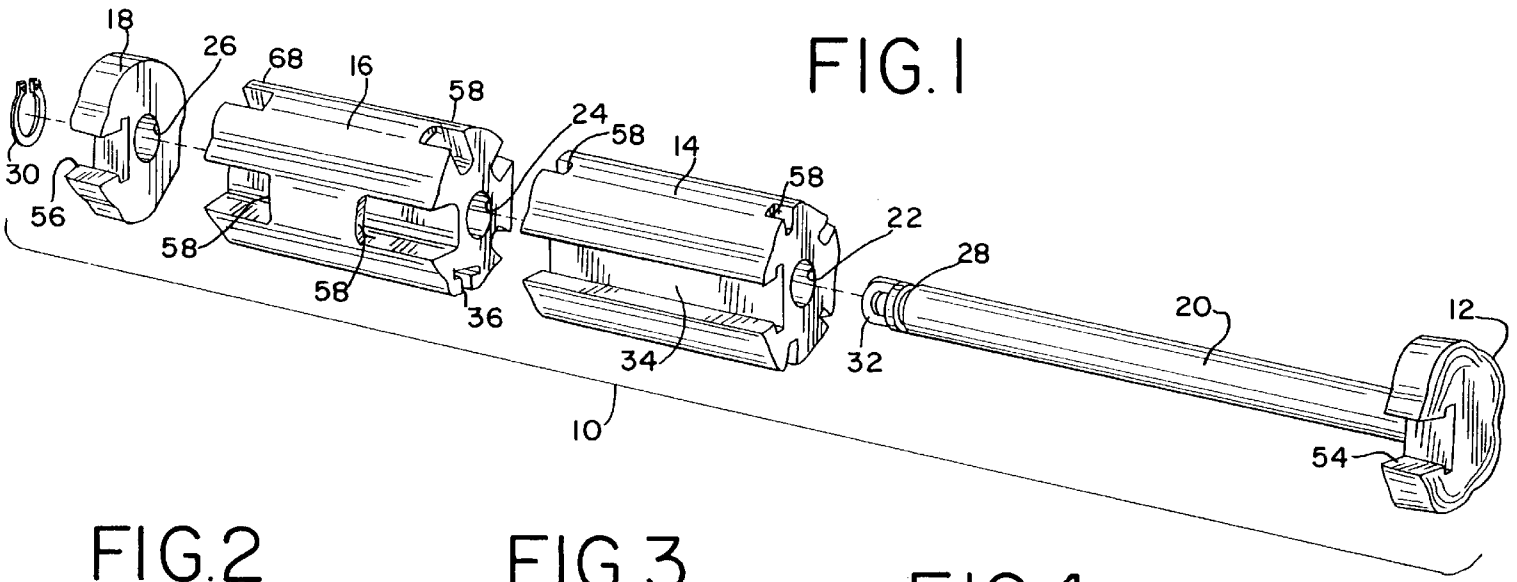
FIG. 1 is an exploded perspective view of a tool handle according to the present invention.
Figure 2:
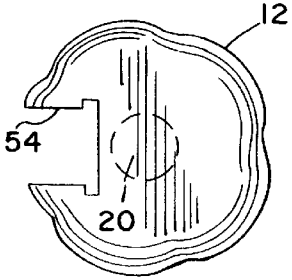
FIG. 2 is an end view of the right-hand end cap of FIG. 1.
Figure 3:
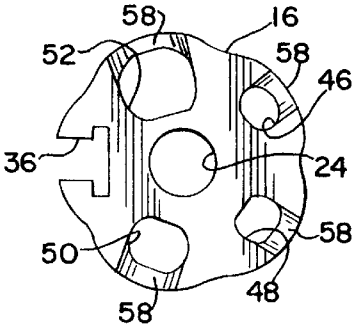
FIG. 3 is an end view of the left-hand cylindrical member of FIG. 1.
Figure 4:
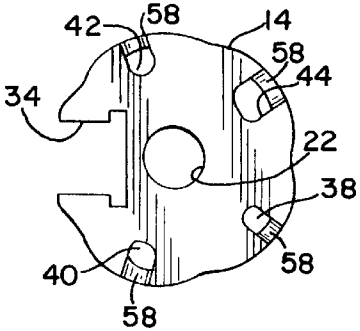
FIG. 4 is an end view of the right-hand cylindrical member of FIG. 1.
Figure 5:
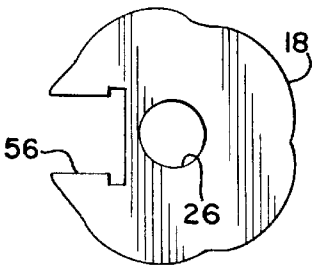
FIG. 5 is and end view of the left-hand end cap of FIG. 1.

Turning to FIG. 1, there is seen an exploded perspective view of a tool handle, generally indicated 10, according to the present invention. The tool handle 10 is preferably made of glass-reinforced nylon and includes a right-hand end cap 12, a right-hand cylindrical member 14, a left-hand cylindrical member 16, and a left-hand end cap 18. While the members 14 and 16 are generally cylindrical in appearance, as best seen in FIGS. 3 and 4, the members 14, 16, are more accurately described as having a pentagonal shape with gently-rounded corners. In practice, the "diameter" of the members 14, 16 is on the order of one and a half inches. This diameter, combined with the rounded, pentagonal shape, provides the user with a comfortable gripping surface.

Each of the end caps 12, 18 and cylindrical members 14, 16 is mounted for rotational movement independent of each of the other pieces on an axle member 20. As illustrated, the axle member 20 is formed integrally with the right-hand end cap 12 and is received in a central through bore 22, 24, 26 in each of the right-hand cylindrical member 14, left-hand cylindrical member 16, and left-hand end cap 18, respectively.

The axle 20 is sized in length to extend through the left-hand end cap 18 when all the pieces 14, 16, 18 are received on the axle 20. The axle 20 includes a circumferential slot 28 adjacent to its left-hand end that is adapted to receive a snap ring 30 so as to secure each of the left-hand end cap 18, left-hand cylindrical member 16 and right-hand cylindrical member 14 to the axle member 20.

The right-hand end cap 12 is secured to the axle member 20, due to the axle member 20 being formed integrally with the right-hand end cap. Alternatively, the right-hand end cap can be formed with a through bore, like the through bore 26 in the left-hand end cap 18. Then the right-hand end of the axle would also have a circumferential slot for receiving a snap ring, in the same manner as the left-hand end of the axle member 20.

The left-hand end of the axle member 20 is preferably formed with a loop 32. The loop 32 may be used to receive a strap, cord, hook or clip (none of which are shown) to facilitate the storage and carrying of the tool handle 10.

In keeping with the invention, each of the end caps 12, 18 is formed with a slot, while each of the cylindrical members 14, 16 is formed with a series of through bores and a slot. These slots and through bores permit the tool handle 10 to be selectively manipulated to receive either the short leg or long leg of an L-key upon appropriate rotation of the end caps and cylindrical members.

With reference to FIGS. 1–5, each of the cylindrical members 14, 16 includes a slot 34,36, respectively, that is formed at the surface of the cylindrical member along the entire length thereof. Each cylindrical member 14, 16 also includes a series of longitudinally-extending through bores adjacent its surface, the through bores being of various sizes so as to receive the shanks of variously-sized L-keys. As illustrated, each cylindrical member has four such through bores, so that eight different sizes of L-keys can be accommodated. However, the number of through bores may be changed so as to accommodate a greater number of differently-sized L-keys.

As illustrated, the right-hand cylindrical member 14 includes four through bores 38, 40, 42, 44 of graduated diameters for receiving relatively smaller-sized L-keys. For example, through bores 38, 40, 42 and 44 may be sized to receive the shanks of 7/64", 1/8", 5/32" and 3/16" L-keys, respectively.

The left-hand cylindrical member 16 also includes four through bores 46, 48, 50, 52 of graduated diameters for receiving relatively larger-sized L-keys. For example, through bores 46, 48, 50 and 52 may be sized to receive the shanks of 7/32", 1/4", 5/16" and 3/8" L-keys, respectively.

The slots 34, 36 and the cylindrical members 14, 16 are sized to accommodate the largest-sized L-key received in the adjacent cylindrical member. For example, the slot 34 and the cylindrical member 14 are sized to accommodate a 3/8" L-key, while the slot 36 in the cylindrical member 16 is sized to accommodate a 3/16" L-key.

In addition, both end caps 12 and 18 include a cutout 54, 56, respectively, that corresponds in shape to the slot 34, for receiving the largest sized tool, which in the example is a 3/8" L-key. As illustrated, each of the slots 34, 36 and cutouts 54, 56 are T-shaped. This permits added versatility for the tool in that the slots may receive other tools or accessories that have a T-shaped flange.

Each through bore 38–52 is cut away at 58 adjacent each end of their associated cylindrical member 14, 16 to expose the interior of the through bore. The cut away portion 58 is sized to accommodate the bend portion of the L-key that is received therein.

Figure 6:
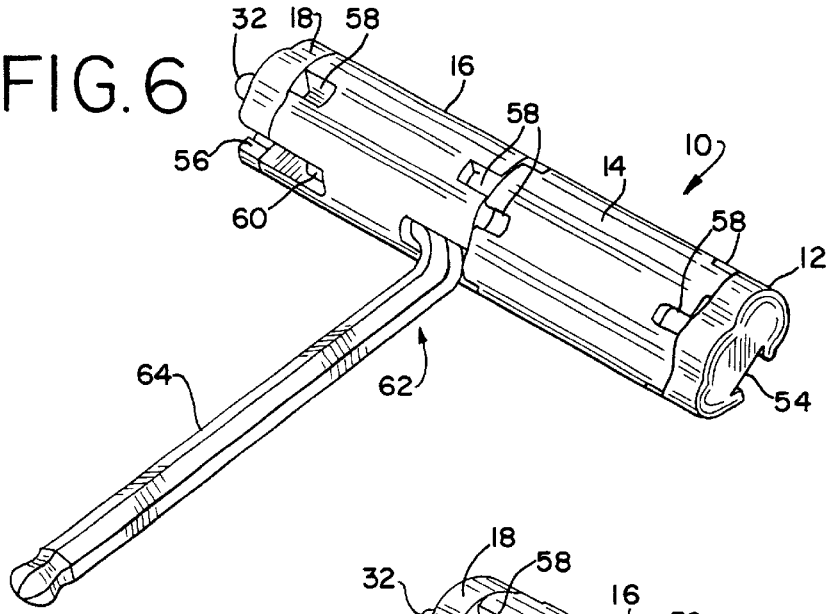
FIG. 6 is a perspective view of the tool handle according to the present invention in conjunction with an L-key, with the tool handle being secured to the short leg of the L-key and forming a T-handle.
Figure 7:
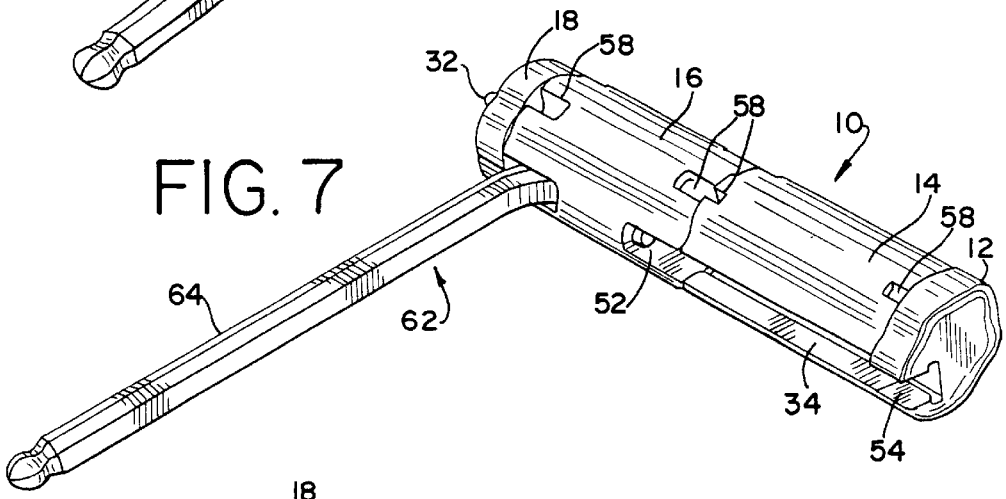
FIG. 7 is a perspective view similar to FIG. 6, but showing a second way for the tool handle to be secured to the short leg of an L-key.
Figure 8:
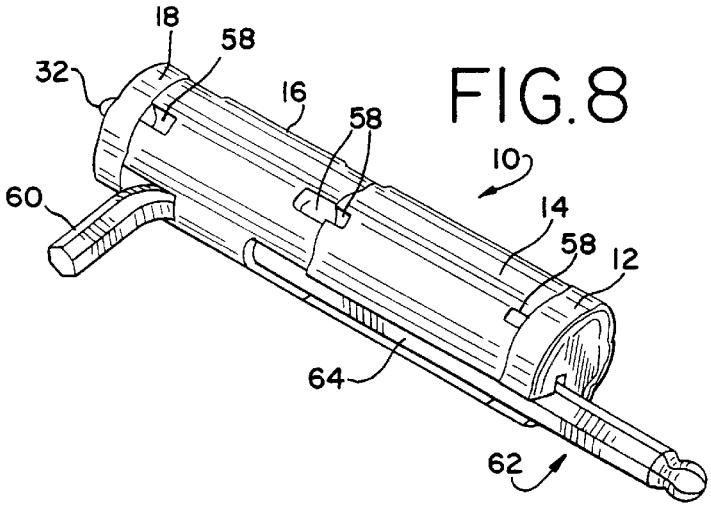
FIG. 8 is a perspective view similar to FIGS. 6 and 7, but showing the tool handle being secured to the long leg of the L-key.

Thus configured, the various end caps and cylindrical members of the tool handle 10 can be manipulated so as to receive any of eight differently-sized L-keys in three different positions, which are illustrated in FIGS. 6–8. FIGS. 6–8 show these three different methods of using the tool handle 10 in conjunction with the largest-sized tool, the 3/8" L-key, that can be accommodated by the handle. The tool handle 10 may secure the short leg 60 of the L-key 62 to form a T-handle (FIG. 6); secure the short leg 60 of the L-key 62 to form a larger handle for an L-shaped tool (FIG. 7); or secure the long leg 64 of the L-key 62 to again form a larger handle for the L-shaped tool (FIG. 8).

In order to use the tool handle 10 as a T-handle as shown in FIG. 6, the slot 34 or 36 of one of the cylindrical members 14 or 16 is first aligned with the appropriately-sized through bore 38-52 for receiving the L-key on the other cylindrical member. The short leg 60 of the L-key 62 is then placed into the through bore by sliding it along the slot. Then, the cylindrical member with the slot is rotated out of alignment with the through bore that received the short leg of the L-key to prevent the L-key from unintentionally sliding out of the through bore.

In order to use the tool handle 10 as shown in FIG. 7, the slot 54 or 56 in the end cap 12 or 18 is aligned with the through bore on the adjacent cylindrical member 14 or 16 that is sized to receive the L-key. The short leg of the L-key is then slid into the through bore. The end cap may then be rotated to prevent the L-key from unintentionally sliding out of the through bore.

In order to use the tool handle 10 as shown in FIG. 8, the slots in the end caps and the adjacent cylindrical member are aligned with the through bore sized to receive the tool. Then the long leg 64 of the L-key 62 is inserted through the slot in the end cap adjacent to the cylindrical member having the through bore aligned with the end cap. The long leg of the L-key is then slid through the aligned through bore and slots in the adjacent cylindrical member and end cap. After the L-key is moved to the position shown in FIG. 8, the end cap may be rotated out of alignment with the through bore 52 to prevent unintended removal of the L-key from the handle.

Accordingly, a tool handle has been provided that meets all of the objects of the present invention. While the tool handle has been described in terms of a preferred embodiment, there is no intent to limit the invention to the same. Instead, the invention is defined by the scope of the following claims.

What is claimed:

1. A tool handle for receiving a plurality of L-key wrenches of varying sizes comprising:

an elongated axle member;

first and second generally-cylindrical members each having a central bore for receiving the axle member, the first and second generally-cylindrical members being mounted end-to-end on the axle member for independent rotational movement with respect thereto, each of the first and second generally-cylindrical members having an elongated slot along the length thereof and a plurality of through bores of varying size spaced radially from the central bore and adapted to receive the shank portion of an L-key wrench; and first and second end caps secured to the elongated axle member, both the first and second end caps having a slot therein and being rotatable with respect to the first and second generally-cylindrical members so that the slots in the end caps are selectively alignable with the slot and radially-spaced through bores in its adjacent generally-cylindrical member, whereby the slot in an end cap may be selectively aligned with either one of the radially-spaced through bores in the adjacent generally-cylindrical member to permit a hex key to be secured therein or with the slot in the adjacent generally-cylindrical member to permit a L-key wrench to be secured in the other generally-cylindrical member.

2. The tool handle of claim 1 wherein the surface of each of the generally-cylindrical members is relieved at the ends of its associated radially-spaced through bores in an amount corresponding to the size of the L-key adapted to be received in the through bore.

3. The tool handle of claim 1 in which the radially-spaced through bores in the first cylindrical member are each of a different size than the radially-spaced through bores in the second cylindrical member.

4. The tool handle of claim 1 wherein the slots in the first and second cylindrical members are sized to correspond to the largest through bore in the first and second cylindrical members, respectively.

5. The tool handle of claim 1 wherein the slots in the end caps are sized to receive the largest-sized hex key for which the tool handle is designed.

6. The tool handle of claim 1 wherein the all of the through bores and one of the generally-cylindrical members are larger than each of the through bores in the other generally-cylindrical member.

7. The tool handle of claim 1 wherein one of the end caps is formed integrally with the axle member.

8. The tool handle of claim 1 wherein the cylindrical members have a pentagonal cross-sectional shape with rounded corners.

9. The tool handle of claim 1 wherein the axle member includes an end portion that extends through the end cap, and the end cap and cylindrical members are secured to the axle by a snap ring.

10. The tool handle of claim 9 wherein the end portion of the axle member is formed with a loop.

* * * * *